United States Patent [19]

Paton et al.

[11] Patent Number: 4,637,320

[45] Date of Patent: Jan. 20, 1987

[54] ARTICULATED GONDOLA RAILCAR

[76] Inventors: H. Neil Paton, 2521 W. Montlake Pl. E.; John B. Skilling, 539 McGilvra Blvd. E., both of Seattle, Wash. 98112

[21] Appl. No.: 547,967

[22] Filed: Nov. 2, 1983

Related U.S. Application Data

[63] Continuation-in-part of Ser. No. 382,728, May 27, 1982, abandoned, which is a continuation-in-part of Ser. No. 238,413, Feb. 26, 1981, abandoned.

[51] Int. Cl.[4] ..... B61D 3/00; B61D 7/00

[52] U.S. Cl. ..... 105/406.1; 105/3; 105/416; 298/1 B

[58] Field of Search ..... 105/3, 4 R, 244, 245, 105/246, 404, 406 R, 416, 417, 418, 413, 414; 222/386; 414/539, 417, 358, 355, 364–366; 298/1 B, 8 T, 9

[56] References Cited

U.S. PATENT DOCUMENTS

| | | | |
|---|---|---|---|
| 684,624 | 10/1901 | Vanderbilt | 105/414 |
| 751,299 | 2/1904 | King | 105/248 |
| 766,701 | 8/1904 | King | 105/414 |
| 2,620,751 | 12/1952 | Watter | 105/416 |
| 3,572,252 | 3/1971 | Coover et al. | 105/406 R |
| 3,713,400 | 1/1973 | Teoli | 105/406 R |
| 3,817,189 | 6/1974 | Bailey et al. | 105/406 R |
| 3,841,236 | 10/1974 | Hammonds et al. | 105/406 R |
| 4,254,714 | 3/1981 | Heap | 105/416 |
| 4,331,083 | 5/1982 | Landregan et al. | 105/416 |
| 4,356,775 | 11/1982 | Paton et al. | 105/3 |
| 4,408,542 | 10/1983 | Heap | 105/406 R |

FOREIGN PATENT DOCUMENTS

| | | | |
|---|---|---|---|
| 2716435 | 5/1978 | Fed. Rep. of Germany | 105/406 R |

OTHER PUBLICATIONS

"Car and Locomotive Cyclopedia of American Practice", 1966, p. 179.

*Primary Examiner*—Randolph A. Reese
*Assistant Examiner*—Donald T. Hajec

[57] ABSTRACT

The railcar includes two car units interconnected by a drawbar. The drawbar and conventional outboard end couplers are mounted at the locations spaced apart along the longitudinal center lines of the car units. Each car unit is made up of a gondola carbody and two single axle trucks which support the carbody at four vertical load support points. Each carbody includes a depressed center section and a through sill which extends between the drawbar and the coupler within the center section for transmitting buff and draft forces along a rectilinear load path which coincides with the longitudinal center line of the car unit. Essentially all vertical loads imposed on the center section are transmitted to and borne by the side walls. The railcar may be of nonarticulated construction, but in either case is particularly suited for fabrication from aluminum.

21 Claims, 6 Drawing Figures

ARTICULATED GONDOLA RAILCAR

CROSS REFERENCE TO RELATED APPLICATION

This application is a continuation-in-part of Ser. No. 382,728, filed May 27, 1982, now abandoned, which is a continuation-in-part of Ser. No. 238,413, filed Feb. 26, 1981, now abandoned.

FIELD OF THE INVENTION

This invention relates to railcars and, more particularly, to gondola railcars.

BACKGROUND OF THE INVENTION

Gondola railcars are used to carry bulk material such as coal and the like, and may be rotated by rotary dump equipment about their longitudinal axes to an inverted position for unloading, without uncoupling from adjacent railcars. Typically, these cars include one rotary coupler which remains coupled to a following car, and one nonrotary coupler which is coupled to a rotary coupler of a preceding car.

To provide added load carrying capacity, many of these cars have a depressed center section in which the floor of the car extends below the side sills in a curved configuration, either parallel or perpendicular to the center line of the car. Examples of cars with the parallel curved depressed center section, which commonly are referred to as "bathtub" gondolas, are illustrated and described in U.S. Pat. Nos. 3,713,400 and 3,817,189. An example of a car with two perpendicular curved depressed center sections, which commonly is referred to as a "twin tub" gondola, is illustrated and described in U.S. Pat. No. 4,212,252.

In depressed center section gondola railcars such as those just mentioned, buff and draft forces are transmitted between the couplers via the side sills. Shear plates transmit buff and draft forces between center stub sills located at the ends of the car and the side sills. In many practical cases, the shear plates are fabricated from steel sheets as thick as $\frac{3}{8}$ inch to $\frac{1}{2}$ inch and, in some cases, it is necessary to provide additional reinforcement to the shear plates in the form of diagonal or longitudinal bracing. Despite such reinforcement, however, the shear plates and side sill connections tend to be susceptible to fatigue cracking and other types of failure. Additionally, the shear plates, together with any such reinforcement, tend to increase the weight of the car. Accordingly, the side sill load path employed in such gondola railcars tends to be unsatisfactory.

Rising fuel and other costs, together with increased maintenance-of-way costs, have created the need for a gondola railcar which is economical to operate and offers a rapid return on investment. Conventional steel gondola railcars of the type mentioned above tend to be unsatisfactory from this standpoint, mainly because they feature designs which tend to sacrifice operating economy, in particular weight savings, in favor of structural integrity. The reaction to failures discussed above stems from and exemplifies this philosophy. Another reason for this is that the steel sheets, which make up the side and end walls and bottom of steel gondola railcars, are designed with added thickness sufficient to offset anticipated corrosion loss. This of course increases the car weight substantially, again at the expense of operating economy. Such steel gondola railcars also require extensive painting and corrosion treatment, periodic repainting, resheeting, and the provision of interior linings which require periodic replacement, all of which further degrade their operating economy.

The use of aluminum instead of steel for the car material has been considered for some time as an economically attractive alternative for lowering fuel and other operating costs, together with maintenance-of-way costs. Aluminum provides a higher strength-to-weight ratio, along with the potential for reducing the weight of a corresponding steel car by approximately 20 percent. This of course can be translated into more payload capacity and hence a reduction in number of cars necessary to transport a given quantity of bulk material in a single train, fewer hauls and, in some cases, fewer locomotives. Additionally, since aluminum is corrosion resistant, it offers a longer service life and less maintenance, does not require painting or other protective coatings, can be fabricated using modern techniques, and does not require added material thickness to counteract corrosion effects. A further economic advantage is the higher scrap value of the aluminum.

Though the foregoing advantages of aluminum have been known for some time, most gondola railcars continue to be fabricated from steel. Those gondola railcars which are fabricated from aluminum, moreover, commonly are based upon steel car designs which, as discussed above, tend to be uneconomical. Thus, while some weight savings may be obtained by using aluminum, the basic gondola railcar design employed often imposes such inherent weight and cost penalties that the resultant aluminum car does not appear as an economical alternative to the corresponding steel gondola railcar.

SUMMARY OF THE INVENTION

A principal object of this invention is to provide a depressed center section gondola railcar that transmits buff and draft forces by means other than shear plates and the side sills.

Another object of this invention is to provide a depressed center section gondola railcar in which essentially all vertical loads are received by the side walls.

Still another object of this invention is to provide a depressed center section gondola railcar that is lighter in weight than "bathtub" and other conventional gondola railcars, and that is particularly suitable for fabrication of aluminum.

To attain these objects and in accordance with the principles of this invention, this invention provides a gondola railcar that comprises a carbody supported by two spaced apart trucks and two coupler means respectively located adjacent the ends of the carbody. The carbody includes a depressed center section located between the trucks, through sill means extending between the coupler means for transmiting essentially all buff and draft forces between the coupler means along a rectilinear load path aligned with the coupler means, and wall means operatively connected to the center section for receiving essentially all vertical loads applied to the center section.

According to further aspects of the present invention, an articulated gondola railcar made up of two or more articulated car units is provided. Each car unit includes a gondola body with a depressed center secton and through sill means of the type described above, together with two single axle trucks which support the body at four spaced apart vertical load support points. The car units are interconnected by articulation means attached to the inboard ends of the car units at locations aligned with the outboard end couplers. While it is preferred to use single axle trucks with four point suspension, it also is possible to use conventional two point suspensions in this invention, either with single axle trucks or double axle trucks.

According to still further aspects of the present invention, unloading of the bulk material from the center section is facilitated even under frozen conditions when the material tends to adhere to the interior surface of the center section. The material is swept from the interior surface by one or more drop plates which are connected to and swing beneath the through sill means at close clearance with that surface. While one drop plate could be used, it is preferable in some applications, especially coal-carrying gondolas, to employ two drop plates which are positionable in parallel alignment when the car is upright, since the two plates also may serve to keep the coal or other material from accumulating beneath the through sill means, where it might become difficult to unload or tend to clog drain holes in the bottom of the center section.

Thus, it will be appreciated from the foregoing summary that this invention eliminates shear plates and their attendant reinforcement structure heretofore required for transmission of buff and draft forces between the couplers via the side sills. Consequently, the effects of shear, torsional or other stresses, such as those which tend to appear in conventional gondola railcars, are substantially minimized or eliminated. This invention also enables the through sill means to be designed and constructed of reduced bending strength, since it experiences very little vertical loading. The gondola railcar according to this invention therefore is significantly lighter in weight than the gondola railcars of the type described above, whether fabricated in steel, aluminum, or other materials.

Accordingly, this invention for the first time substantially mitigates the problems associated with conventional gondola railcars, whether made of steel, aluminum, or other materials. The gondola railcar of this invention offers lower operating costs, in terms of fuel, labor and maintenance costs, bigger payload capacity, reduced maintenance-of-way costs, and other economies, and is particularly suited for aluminum fabrication with the attendant advantages thereof. When constructed as an articulated railcar and/or equipped with single axle trucks, this invention provides still further economies and reductions in maintenance-of-way costs heretofore not practically attainable.

While it is preferable to provide an articulated gondola railcar with single axle trucks, all aluminum fabricated, in order to maximize the economic advantages offered by this invention, it will be recognized that in some cases, it may be necessary or desirable to make trade-offs between economy and other factors in order to satisfy the requirements of specific applications. In these cases, the railcar of this invention need not be articulated and may be fabricated in whole or in part from steel or other materials besides aluminum. Therefore, the following description of the presently preferred embodiment of this invention should be considered as illustrative and not limiting.

These and other features, objects and advantages of the present invention will become apparent from the detailed description and claims to follow, taken in conjunction with the accompanying drawings, in which like parts bear like reference numerals.

DETAILED DESCRIPTION OF THE DRAWINGS

Figure 1:
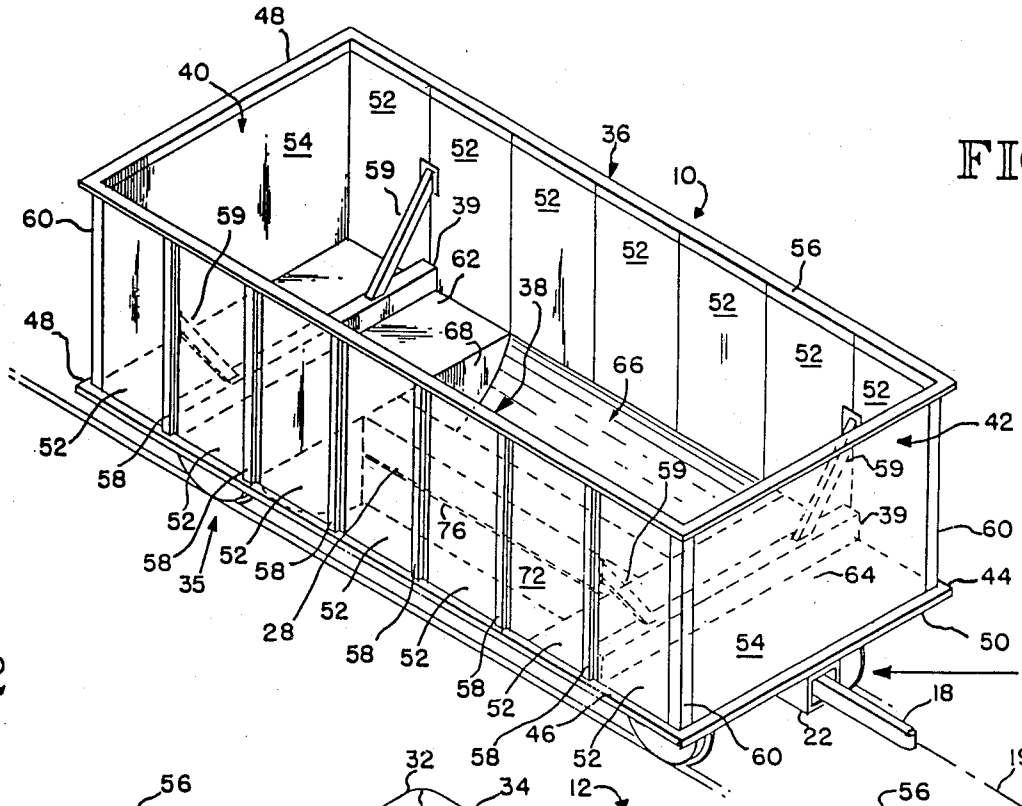
FIG. 1 is a perspective view of one unit of the presently preferred articulated gondola railcar according to this invention.
Figure 2:
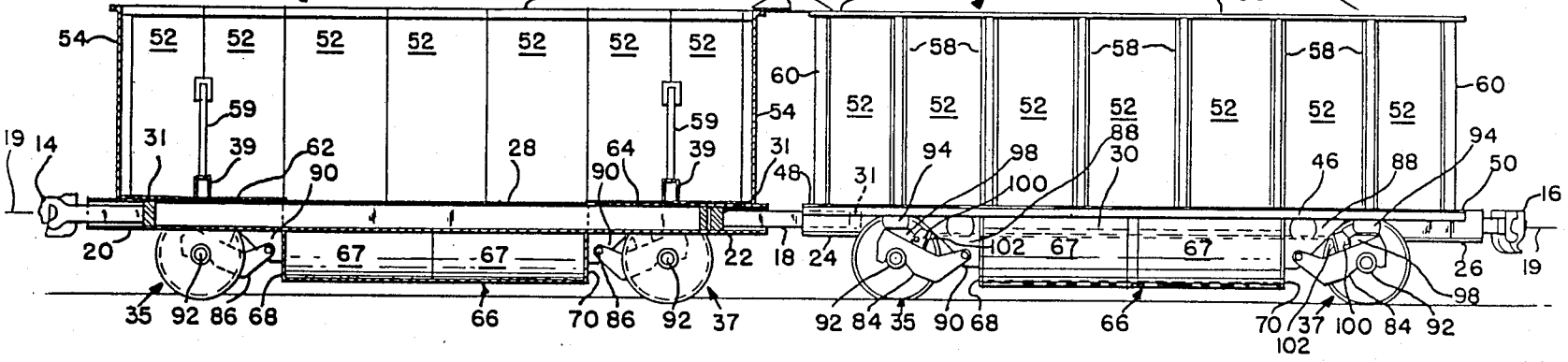
FIG. 2 is a side elevational view of the presently preferred gondola railcar according to this invention, made up of two articulated FIG. 1 units, depicting one unit in longitudinal section.
Figure 3:
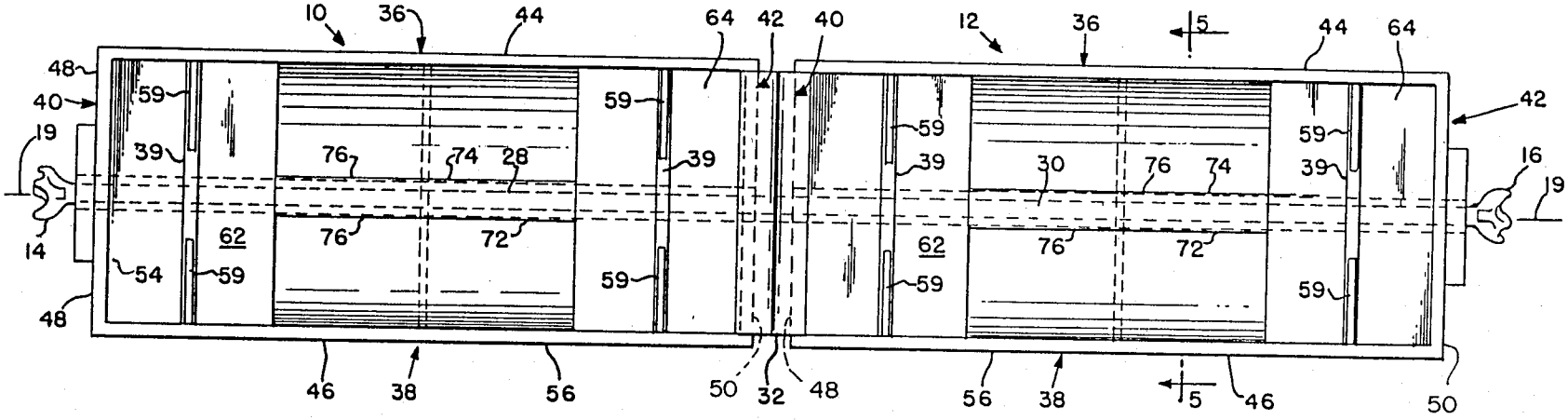
FIG. 3 is a top plan view of the FIG. 2 railcar.

One presently preferred embodiment of the gondola railcar according to this invention, as illustrated in FIGS. 1–6, is comprised of two articulated car units (generally referenced by numerals 10 and 12), each having a depressed center section 66 (FIG. 2). One conventional type F rotary coupler 14 is mounted by the outboard end of unit 10, and one standard coupler 16 is mounted by the outboard end of unit 12. An articulated drawbar 18 interconnects the inboard ends of units 10 and 12 and allows units 10 and 12 to swivel with respect to one another when cornering. The length of the illustrated articulated gondola railcar between the couplers 14 and 16 corresponds to the length of a conventional gondola railcar. Hence, both units 10 and 12 may be rotated and inverted in unison by existing rotary dump equipment so that they can be unloaded simultaneously.

Buff and draft forces are transmitted between couplers 14 and 16 along the center lines 19 of the car units by draft sills 20, 22, 24, and 26, through sills 28 and 30, and drawbar 18. The through sills 28 and 30 respectively extend the lengths of units 10 and 12, with their outboard ends connected to draft sills 20 and 26 and their inboard ends connected to draft sills 22 and 24. In the example, each through sill is a hollow beam member which is of tubular configuration, generally square in transverse cross section as shown (FIG. 5), and which extends along center line 19. The couplers 14 and 16 and drawbar 18 are mounted by supports 31 (one not shown) within the draft sills at spaced locations along center line 19. Consequently, as most clearly illustrated in FIGS. 1–4, the load path along which the buff and draft forces are transmitted via the through sills is rectilinear, and is aligned with the couplers and the ends of the drawbar and hence with the vectors along which buff and draft forces are applied. This substantially eliminates moments or force couples that otherwise might tend to appear if the load path were offset with respect to the buff and draft force vectors. Further, since the outboard ends of the through sills support and are connected to the couplers and drawbar via the draft sills, buff and draft forces are applied directly to the through sills.

Unlike conventional gondola railcars of the type mentioned above, therefore, side sills are excluded from this load path, and shear plates for providing transverse load transmission to and from the side sills are not required. This could account for a weight reduction of approximately 5 percent, as compared for example to a corresponding "bathtub" gondola equipped with standard shear plates and side sills. Further weight reductions are obtainable since essentially all vertical loads are transmitted to and borne by the side walls instead of the through sills, as will be described presently, and therefore the through sills need not serve as the principal vertical load bearing members for the carbodies, as in some conventional gondola or hopper railcars. Consequently, the through sills may be of reduced bending strengths sufficient to withstand only those vertical loads that are not received by the side walls, together with any additional vertical loads that may be imposed upon them directly. With this construction, therefore, the gondola railcar of this invention is lighter in weight and is less prone to fatigue or other failures heretofore attributable to center sill supported carbodies and side sill load path designs found in conventional railcars.

Referring again to FIGS. 1–3, a transom 32 is mounted on unit 10 and spans the space between the inboard ends of the units 10 and 12. Transom 32 forms oppositely inclined loading surfaces for deflecting the bulk material in opposite directions into units 10 and 12 during loading. In the example, transom 32 is hinged to the upper inboard end of unit 10 and is provided with a stop (not shown) which limits rotative motion of the transom when the railcar is inverted during unloading or dumping. A strip of low friction material 34 is mounted by the upper end of unit 12 for contact with the opposite end of transom 32 so as to permit free sliding movement therebetween when the units swivel with respect to one another during cornering.

Each of the car units 10 and 12 include two single axle trucks (generally referenced by numerals 35 and 37) and a carbody which is supported by the trucks at four spaced apart vertical support points, one pair at each end of the carbody spaced transversely from center line 19 and located outboard of the truck wheels, as shown (FIG. 4) and as will be described in further detail hereinafter. Each carbody is made up of two transverse bolsters 39 which extend over the through sill with their ends overlying respective pairs of vertical load support points, and fronting upon parallel side walls 36 and 38. The side walls 36 and 38 are attached to and supported by the ends of bolsters 39. Two spaced apart parallel side sills 44 and 46 extend the lengths of the lower edge portions of the side walls in alignment with the ends of the bolsters, as shown (FIG. 5), as reinforcement and load stiffeners. Two transverse end sills 48 and 50 connect the ends of the side sills together and extend along the lower edge portions of end walls 40 and 42.

Each of the side walls 36 and 38 is made up of multiple flat panels 52 which, in the example, are of rectangular configuration and extend with their major sides vertical. These panels preferably are welded together along their adjoining edges in generally planar alignment. In the example, each end wall is made up of a single flat panel 54. A stiffener 56 generally L-shaped in cross-section extends about the upper edges of the side and end walls, and additional side stiffeners 58 generally U-shaped in cross section overlap the adjoining edges of intermediate panels 52 for stiffening the side walls. As additional stiffening, four side braces 59 extend diagonally between bolsters 39 and the side walls. Corner stiffeners 60 generally L-shaped in cross section overlap the adjoining edges of the side wall panels and the end walls. Generally similar horizontal or vertical stiffeners may be provided on the end walls 54 as reinforcement against outward buckling loads. It will be recognized that the side and end walls may be fabricated from different panel configurations depending upon the materials and type of fabrication techniques employed. For example, the side walls could be made up of elongated panels extending the length of the unit in horizontal alignment, with horizontal stiffeners overlapping the adjoining panel edges.

Figure 5:
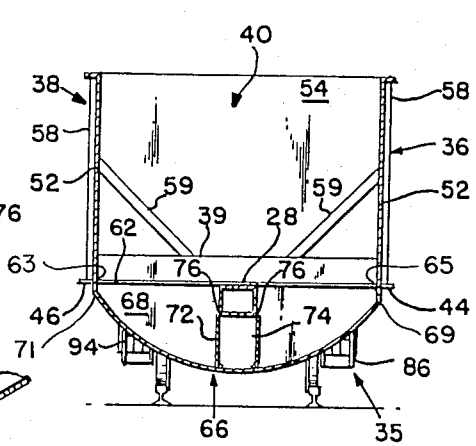
FIG. 5 is a section taken along the line 5—5 in FIG. 3.

Each carbody further includes a floor made up of two horizontal end panels 62 and 64 supported by the side and end walls 36, 38, 40, and 42 in overlying relation to trucks 35 and 37. As most clearly shown in FIGS. 3 and 5, panels 62 and 64 are supported along their side and outboard edges by the side and end walls 36, 38, 40, and 42 in underlying relation to bolsters 39. The side edges of panels 62 and 64 are connected at 65 and 63 to the lower edge portions of side walls 36 and 38, at the level of side sills 44 and 46, as shown (FIG. 5). Thus, vertical loads applied to panels 62 and 64 will be transmitted to and received by the side walls 36 and 38. (Panels 62 and 64 also extend over and are connected to the through sill, as will be described presently.) The inboard edges of panels 62 and 64 are connected to and support the depressed center section 66.

The depressed center section 66 is located between the trucks 35 and 37 and extends downward below the plane of end panels 62 and 64 to a lower terminus having a ground clearance prescribed by the American Association of Railroads (AAR) standards. As most clearly illustrated in FIG. 5, section 66 is curved with respect to center line 19 and, preferably, is formed as a catenary with respect to two vertical load support edges 69 and 71 provided by the lower edges of side walls 36 and 38. With this construction, the bulk material lading produces a tension load upon section 66, with essentially no bending loads. In the example, section 66 is formed by two curved side panels 67 which are welded together along their adjoining edges at a location approximately half way along the length of the section 66. These side panels are secured to and supported along their side edges by the lower edges of side walls 36 and 38 at 69 and 71, below the level of the side sills 44 and 46. Vertical end panels 68 and 70 are secured to the outboard edges of panels 67 and complete the enclosure of the space bounded by section 66. These end panels depend from and are secured to the inboard edges of panels 62 and 64.

The side walls 36 and 38 receive essentially all of the vertical loads imposed upon the center section 66 and end panels 62 and 64. Almost all of the vertical loads from the center section are received by the side walls at 69 and 71 (FIG. 5). The remaining portion of these loads are transmitted via end panels 68 and 70 to end panels 62 and 64, and are received by the side walls at 65 and 63. The end walls of course will receive a portion of the loads transmitted via or imposed upon end panels 62 and 64. Due to the relatively greater stiffness of the side walls as compared to the end walls, however, the vertical loads that appear at the end walls are very small. Consequently, the end walls act primarily to enclose the ends of the carbody, and need to withstand only the outward buckling loads imposed upon them when the railcar is fully loaded.

As most clearly shown in FIG. 5, the through sill underlies and is connected to the end panels 62 and 64. A portion of the vertical loads applied to the end panels 62 and 64, either directly or resulting from vertical loads transmitted from the center section 66, will appear as a vertical load on the through sill. However, since the side walls receive essentially all vertical loads applied to the center section 66 and end panels 62 and 64, the vertical loads thus appearing at the through sill are only a small fraction of the overall vertical loading on the center section 66 and end panels 62 and 64. To the extent vertical loads are received by the side walls and are not applied to the through sill, therefore, the bending strength of the through sill may be reduced and hence a reduction in weight of the through sill may be obtained. In most practical applications, it thus should be possible to achieve substantial reductions in through sill weight. The through sill, of course, still should possess bending strength sufficient to withstand any vertical loads that may be imposed upon it directly from other sources, such as by material accumulated on top of it, or the drop plates or other unloading devices that may be attached to it.

Figure 6:
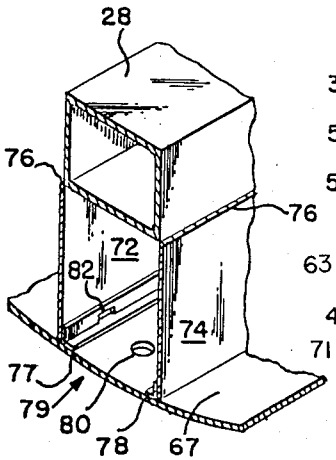
FIG. 6 is a fragmentary perspective in enlarged scale of the through sill and drop plates of the FIG. 2 railcar.
Figure 4:
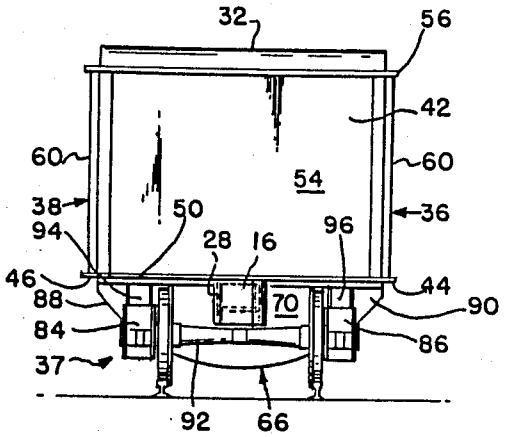
FIG. 4 is an end elevational view of the FIG. 2 railcar.

Referring now in particular to FIGS. 5 and 6, each car unit further includes two elongated drop plates 72 and 74 which are supported by hinges 76 from the lower edges of each through sill to swing transversely about an axis parallel to the center line 19. When the railcar is upright during normal operation, these plates hang downward, as shown (FIG. 5), with their lower edges at close clearance with the interior surfaces of panels 67. The clearance is sufficient to allow one or both plates to rotate outwardly when the railcar is inverted during unloading, depending upon the direction of and the extent to which the railcar is inverted. Two elongated stop strips 77 and 78 are secured to and upstanding from the lower interior surfaces of panels 67 for contact, respectively, with plates 72 and 74 in order to position them in parallel vertical alignment, as shown (FIG. 5), when the railcar is upright. Multiple drain holes 80 are formed in the panels 67 (only one shown in FIG. 6) along the length of the midsection in the space between strips 77 and 78. Slots 82 in strips 77 and 78 (only one slot shown) permit water to enter the space between the strips. Plates 72 and 74 prevent the bulk material lading from entering into and accumulating within that space, and thence from blocking or clogging the drain holes. Additionally, when the car is inverted during unloading, the plates facilitate unloading of the bulk material. They tend to rotate outwardly as the car is inverted, sweeping the bulk material away from the through sill along the interior surfaces of panels 67. This prevents the material from adhering to or being obstructed by the through sill during unloading, especially when the material is frozen.

Referring now to FIG. 2 in particular, each of the single axle trucks 35 and 37 is comprised of two radius arms 84 and 86 which are pivotally supported, respectively, by frame mounts 88 and 90. Mounts 88 and 90 are secured to end panels 68 and 70 and the undersurface of end panels 62 and 64. Each pair of radius arms supports opposite ends of a single wheeled axle 92 and is sprung with respect to the carbody by two elastomeric springs 94 and 96. Springs 94 and 96 are carried by the radius arms in underlying load bearing relation with bolsters 39, each at a location coinciding with one vertical load support point. Each of the springs 94 and 96 rests upon a wedge operator 98 which, in turn, supports a friction shoe 100 that bears against and is slidable with respect to a damping surface 102 formed by the railcar body. As applied load increases, the radius arms pivot while springs 94 and 96 bear against their associated wedge operators with increasing force to produce a frictional damping force which varies in accordance with applied load.

As will be appreciated, the single axle trucks provide four spaced apart vertical support points which coincide with the locations of springs 94 and 96, one pair of transversely spaced apart support points being provided by each truck. With the articulated gondola railcar, eight such load support points are provided, four per car unit, for added stability heretofore not attainable with conventional two point suspensions. Additionally, the single axle trucks tend to be self-steering when the railcar is negotiating a turn, in that increased loading on the outboard load support points causes the outboard ends of the axles to move outwardly to a greater extent than their inboard ends. Further details of the structure and operation of the single axle trucks and the associated suspension just described and illustrated herein are set forth in U.S. Pat. No. 4,356,755, the disclosure of which is incorporated herein by this reference.

While one presently prefered embodiment of this invention has been illustrated and described herein, variations will become apparent to one of ordinary skill in the art. Accordingly, the invention is not to be limited to the particular embodiment illustrated and described herein, and the true scope and spirit of the present invention are to be determined by reference to the appended claims.

The embodiments of the invention in which an exclusive property or privilege is claimed are defined as follows:

1. A gondola railcar, comprising:

a carbody supported by two spaced apart trucks; and two coupler means respectively located adjacent the ends of said carbody;

wherein said carbody includes: a depressed center section located between said trucks; through sill means extending between said coupler means for transmitting essentially all buff and draft forces between said coupler means along a rectilinear load path aligned with said coupler means; two side wall means respectively positioned on opposite sides of said through sill means and operatively connected to said center section for laterally containing the lading of said carbody and for receiving essentially all vertical loads applied to said center section, said center section extending below said side wall means; and two bolster means extending transversely to and overlying said through sill means for supporting said side wall means, and for receiving vertical load bearing support at four vertical load support points, two of which are spaced apart on opposite sides of said through sill means adjacent one end of said carbody and the other two of which are spaced apart on opposite sides of said through sill means adjacent the other end of said carbody.

2. The railcar of claim 1, wherein said coupler means are located on the longitudinal center line of said carbody, and said through sill means extends along said center line in spaced relation to said center section.

3. The railcar of claim 2, wherein said through sill means includes a hollow beam member and two draft sills respectively connected to the ends of said beam member.

4. The railcar of claim 2, wherein said center section is curved about said center line.

5. The railcar of claim 4, wherein said curve is formed as a catenary.

6. An articulated gondola railcar, comprising two car units interconnected at their inboard ends by articulation means, each of said car units comprising:

a carbody supported by two spaced apart trucks; and a coupler located adjacent the outboard end of said carbody;

wherein said carbody includes: a depressed center section located between said trucks; through sill means extending between said coupler and said articulation means for transmitting essentially all buff and draft forces between said coupler and said articulation means along a rectilinear load path aligned with said coupler and said articulation means; two side wall means respectively positioned on opposite sides of said through sill means and operatively connected to said center section for laterally containing the lading of said carbody and for receiving essentially all vertical loads applied to said center section, said center section extending below said side wall means; and two bolster means extending transversely to and overlying said through sill means for supporting said side wall means, and for receiving vertical load bearing support at four vertical load support points, two of which are spaced apart on opposite sides of said through sill means adjacent one end of said carbody and the other two of which are spaced apart on opposite sides of said through sill means adjacent the other end of said carbody.

7. The railcar of claim 6, wherein said coupler and said articulation means are located on the longitudinal center line of said carbody, and said through sill means extends along said center line in spaced relation to said center section.

8. The railcar of claim 7, wherein said through sill means includes a hollow beam member and two draft sills respectively connected to the ends of said beam member.

9. The railcar of claim 7, wherein said center section is curved about said center line.

10. The railcar of claim 9, wherein said curve is formed as a catenary.

11. The railcar of claim 6, further comprising transom means mounted on the inboard end of one car unit and resting upon the inboard end of the other car unit for diverting bulk material into the two car bodies.

12. The railcar of claim 2 or 7, wherein said center section is curved about the longitudinal center line of said carbody, and the railcar further includes plate means pivotally connected to a portion of said through sill means within the space bounded by said center section for swinging beneath said through sill means at close clearance with the interior surface of said center section so as to contact and move material adjacent said interior surface.

13. The railcar of claim 12, wherein said through sill means includes a hollow beam member, and wherein said plate means includes two plates pivotally connected to said beam member at spaced apart locations along the underside of said beam member to swing with respect to the longitudinal axis thereof, and wherein, the railcar further includes stop means upstanding from said interior surface for engaging and positioning said plates when the railcar is upright, at least one of said plates being swingable when the railcar is inverted.

14. The railcar of claim 13, wherein said plates are positioned substantially in parallel alignment when the railcar is upright, and wherein the bottom of said center section includes drain means located between said plates when positioned in said alignment, whereby said plates prevent material from entering the space therebetween.

15. The railcar of claim 2 or 7, wherein said carbody further includes plate means connected to a portion of said through sill means within the space bounded by said center section for preventing accumulation of lading beneath said through sill means, said plate means extending from said through sill means toward said center section and terminating at close clearance with the interior surface of said center section.

16. The railcar of claim 1 or 6, wherein each of said trucks is a single axle truck which includes two radius arms pivotally mounted from said carbody for supporting the ends of a single sheeled axle, two elastomeric springs respectively acting between said two radius arms and said carbody for springing said radius arms with respect to said carbody at two of said load support points, and frictional damping means operatively associated with said elastomeric springs for damping movement of said radius arms with respect to said carbody.

17. The railcar of claim 1 or 6, wherein said carbody further includes a floor supported between said side walls, said floor including two spaced apart planar portions respectively located adjacent the ends of said carbody in overlying relation to said trucks, and an intervening portion curved about the longitudinal center line of said carbody and supported between said planar portions and said side walls forming said center section.

18. A gondola railcar, comprising: a carbody supported by two spaced apart trucks; and two coupler means respectively located adjacent the ends of said carbody; said carbody having two parallel side walls supporting a center section depressed below the level of said coupler means between said trucks and curved about the longitudinal center line of said carbody, through sill means extending between said coupler means parallel to and between said side walls in spaced relation to said center section for transmitting essentially all buff and draft forces between said coupler means along a rectilinear load path aligned with said coupler means, and plate means pivotally connected to a portion of said through sill means within the space bounded by said center section for swinging beneath said sill means at close clearance with the interior surface of said center section so as to contact and move material adjacent said interior surface.

19. An articulated gondola railcar, comprising two car units interconnected at their inboard ends by articulation means, each of said car units comprising:

a carbody supported by two spaced apart trucks; and a coupler located adjacent the outboard end of said carbody;

wherein said carbody includes: two parallel side walls supporting a center section depressed below the level of said coupler and said articulation means between said trucks, said center section being curved about the longitudinal center line of said carbody; through sill means extending between said coupler and said articulation means parallel to and between said side walls in spaced relation to said center section for transmitting essentially all buff and draft forces between said coupler and said articulation means along a rectilinear load path aligned with said coupler and said articulation means; and plate means pivotally connected to a portion of said through sill means within the space bounded by said center section for swinging beneath said through sill means at close clearance with the interior surface of said center section so as to contact and move material adjacent said interior surface.

20. The railcar of claim 18 or 19, wherein said through sill means includes a hollow beam member, and wherein said plate means includes two plates pivotally connected to said beam member at spaced apart locations along the underside of said beam member to swing with respect to the longitudinal axis thereof, and the railcar further includes stop means upstanding from said interior surface for engaging and positioning said plates when the railcar is upright, at least one of said plates being swingable when the railcar is inverted.

21. The railcar of claim 20, wherein said plates are positioned substantially in parallel alignment when the railcar is upright, and wherein the bottom of said center section includes drain means located between said plates when positioned in said alignment, whereby said plates prevent material from entering the space therebetween.

* * * * *